United States Patent [19]

Hoffmann

[11] 3,995,415

[45] Dec. 7, 1976

[54] LAWN BROOM

[76] Inventor: John Allen Hoffmann, R.R. 1, Lynn Center, Ill. 61262

[22] Filed: Apr. 21, 1975

[21] Appl. No.: 570,229

[52] U.S. Cl. ..... 56/364; 15/83; 56/DIG. 12

[51] Int. Cl.[2] ..... E01H 1/04

[58] Field of Search ..... 56/364, DIG. 12, 12.8, 56/13.3, 14.4, 14.5, 328 R, DIG. 10; 15/79 R, 82–87, 179, 183

[56] References Cited

UNITED STATES PATENTS

| | | | |
|---|---|---|---|
| 283,415 | 8/1883 | Passmore | 56/DIG. 12 |
| 1,803,086 | 4/1931 | Allen | 15/82 X |
| 3,591,883 | 7/1971 | Armstrong | 15/79 R |
| 3,643,283 | 2/1972 | Jahnert | 15/82 X |

FOREIGN PATENTS OR APPLICATIONS

| | | | |
|---|---|---|---|
| 286,925 | 3/1928 | United Kingdom | 56/DIG. 12 |

*Primary Examiner*—J.N. Eskovitz

[57] ABSTRACT

A lawn broom includes a rotary drum having a plurality of sweep elements secured thereon, with each of the sweep elements including a flat mounting strap which extends through an opening provided in the drum. Each mounting strap is provided with an elongated slot and a plurality of mounting pins carried by brackets within the drum slidably extend through the slots provided in the straps to secure the sweep elements on the drum. The pin and slot connections permit the sweep elements to move radially of the axis of rotation of the drum and to tilt from side to side so that the sweep elements, over the entire length of the drum, can follow the contour of the lawn surface.

7 Claims, 5 Drawing Figures

LAWN BROOM

CROSS REFERENCE TO RELATED APPLICATIONS

This application contains subject matter as disclosed in co-pending application Ser. No. 570,228 filed concurrently herewith.

BACKGROUND OF THE INVENTION

The present invention relates generally to lawn care equipment, and more particularly relates to an improved rotary lawn broom.

The typical lawn broom includes a rotary drum having a plurality of rows of bristles secured thereto which sweep the surface to be cleaned upon rotation of the drum. This arrangement has not been completely satisfactory inasmuch as the bristles could not really conform to an uneven ground surface unless at least a portion of the bristles were flexed excessively, and if the rotary drum was lowered beyond its proper working position the bristles would be subjected to undue flexing and strain.

SUMMARY OF THE INVENTION

The object of the present invention is to provide a lawn broom in which the sweeping bristles on the rotary drum are free to move substantially radially on the drum through a predetermined distance. This object is accomplished by forming the rows of bristles in sections with each section of bristles forming a brush or sweep element which is connected to the drum for limited radial movement.

A more specific object of the present invention is to provide an improved rotary lawn broom including a rotating drum having a plurality of individual brushes or sweep elements mounted thereon for limited movement generally radially of the drum and for limited tilting movement.

The above objects and additional objects and advantages of the present invention will become apparent to those skilled in the art from a reading of the following detailed description when taken in conjunction with the accompanying drawings.

DESCRIPTION OF THE PREFERRED EMBODIMENT

Figure 1:
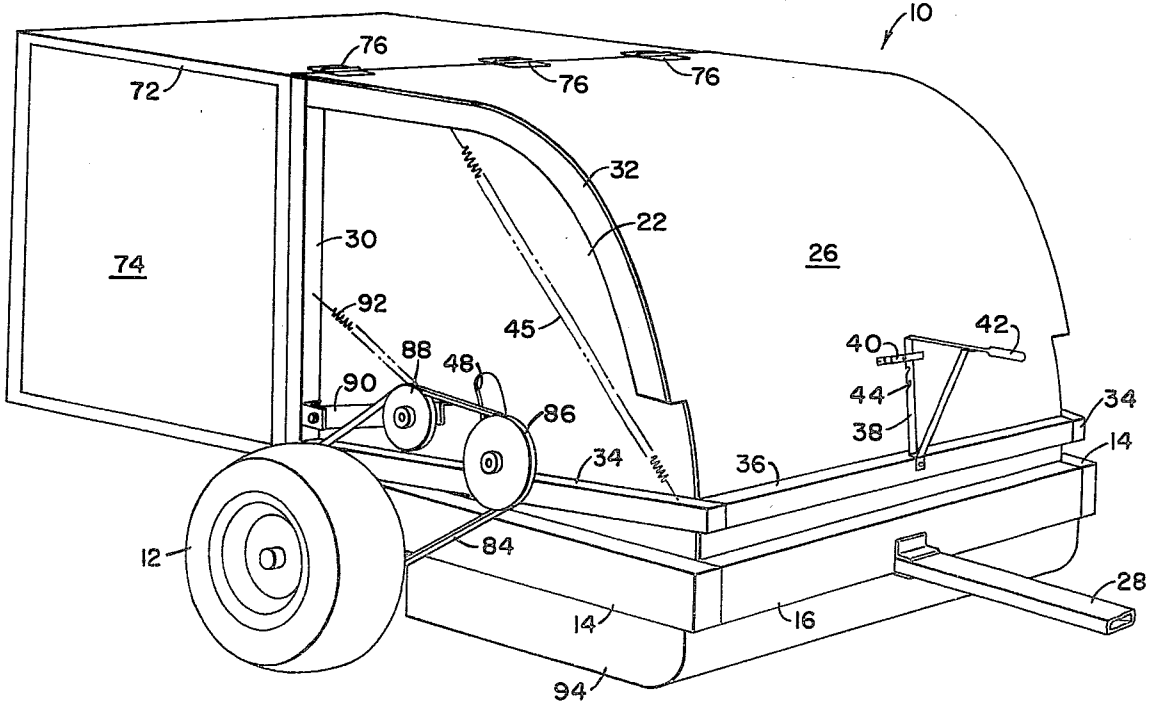
FIG. 1 is a right front perspective view of a lawn broom constructed in accordance with the principles of the present invention.

Referring now to the drawings, a lawn broom constructed in accordance with the principles of the present invention in indicated generally at 10 and includes a housing supported by a pair of wheels 12. The housing includes a pair of lower side frame members 14, a lower front frame member 16 and a lower rear frame member 18. An axle 20 for the wheels 12 extends transversely of the side frame members and is journaled to the bottom of the side frame members 14 in any suitable manner.

The housing further includes a pair of side walls 22, a rear wall 24 and a single piece top and front wall 26 which curves forwardly and downwardly from the upper edge of the rear wall to the lower forward edges of the side walls. A hitch 28 extends forwardly from the front frame member 16 for connection to any suitable propelling vehicle such as a lawn and garden tractor or a riding mower. A pair of upright frame members 30 extend along the juncture of the rear and side walls, and a pair of curved frame members extend along the juncture of the top and side walls.

A sweeping element support frame includes a pair of side members 34 connected at their forward ends by a transversely extending front member 36. The side members 34 have their rear ends pivotally connected to the bottom portion of the rear upright frame members 30. An adjusting strap 38 has one end pivotally connected to the front member 36, extends upwardly through a bracket 40 and terminates in an upper handle portion 42. One edge of the strap 38 is provided with a series of notches 44 which can be engaged over a pin carried by the bracket 40 so as to adjust the vertical position of the sweeping element support frame. A spring 45 on each side of the housing acts between the frame members 32 and side members 34 to counteract the weight of the sweeping element carried on the support frame.

The sweeping element includes an elongated shaft 46 extending transversely of the housing with its opposite ends projecting through elongated slots 48 provided in the side walls and supported by bearings mounted on the side members 34. The slots 48 are curved with a radius of curvature equal to the distance between the pivotal mountings of the rear ends of the side members 34 and the bearings supporting the shaft 46 so that upon pivotal movement of the sweeping element support frame the shaft 46 will not engage the sides of the slots 48.

A drum is mounted on the shaft 46 and includes a pair of end plates 50 mounted on and secured to the shaft 46, and a generally cylindrical covering 52 wrapped about and interconnecting the end plates 50. A plurality of elongated brackets or support bars 54 extend between the end plates 50 adjacent the covering 52 to provide support for the covering 52 and also to serve as mounting means for brushes or sweep elements indicated generally at 56. Each of the brushes 56 includes a base member 58 having a plurality of bristles 60 secured thereto and projecting from one side thereof. A mounting strap 62 is secured to and extends from each base member 58 in a direction opposite from the bristles 60. The mounting straps 62 extend through openings 64 provided in the covering 52 adjacent the elongated brackets 54 and headed pins or bolts 66 carried by the elongated brackets 54 extend through an elongated slot 68 provided in each of the mounting straps 62. The pin and slot connection between the sweep elements 56 and brackets 54 form a lost motion connection which permits the sweep elements to freely move inwardly and outwardly through a fixed distance and in a plane substantially radial of the shaft 46. When the sweep elements 56 are moved outwardly they are also free to tilt from side to side by an amount limited by engagement between the base members 58 of the sweep elements 56 and the covering 52.

The back wall 24 of the housing is provided with an opening 70 which has a width substantially equal to the width of the rotary drum and which extends from the wall 26 downwardly to a level below the upper periphery of the rotary drum. A debris storage container is mounted on the rear portion of the housing to receive debris delivered through the opening 70. The debris storage container includes a rigid frame 72 which has its top, bottom, rear, and sides covered with a hardware cloth 74 and which has its front open. The upper forward edge of the debris container is pivotally connected to the upper rear edge of the housing by hinges 76 and the weight of the container itself normally maintains the front of the debris container against the rear wall of the housing.

In the illustrated embodiment, the shaft 46 is driven by the wheels 12 and to this end a gear 78 is mounted on and secured to the shaft 20 and meshes with and drives a gear 80 rotatably mounted on the side of the housing. The gear 80 includes an integral pulley wheel 82, and a drive belt 84 is trained about the pulley 82 and a pulley 86 mounted on and secured to the shaft 46. An idler pulley 88 rotatably mounted on a pivoted arm 90 is biased into engagement with the belt 84 by spring 92 to maintain proper tensioning of the belt 84 in all vertical positions of the shaft 46.

Figure 2:
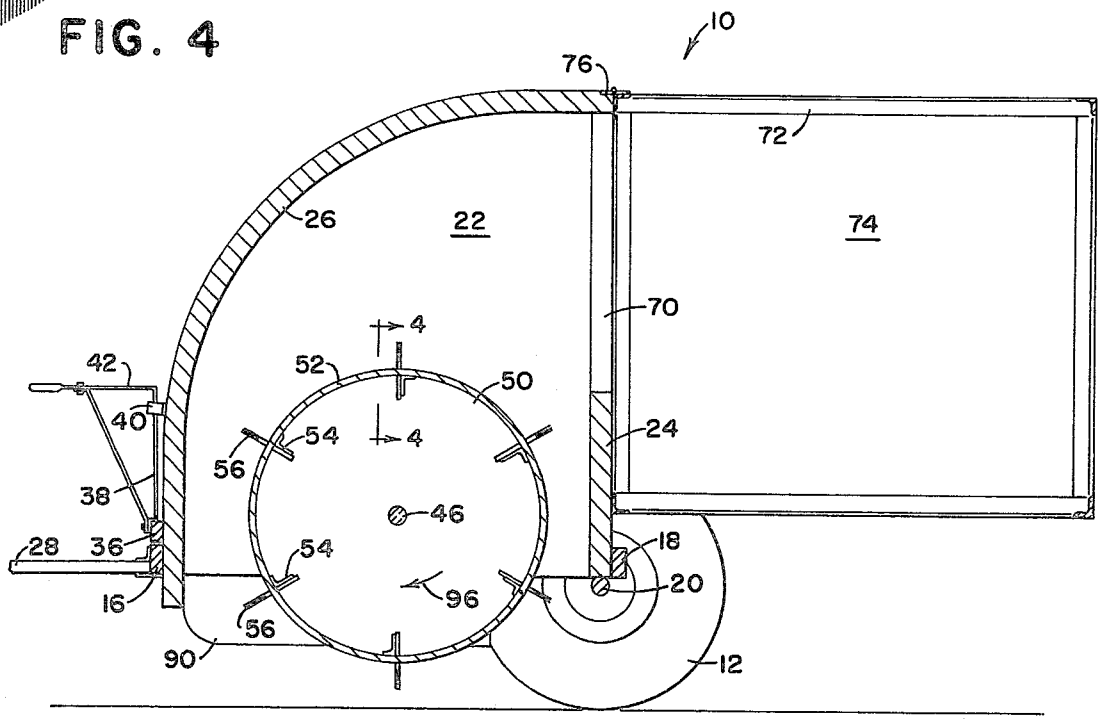
FIG. 2 is a sectional view taken substantially along the fore and aft center line of the lawn broom illustrated in FIG. 1.
Figure 4:
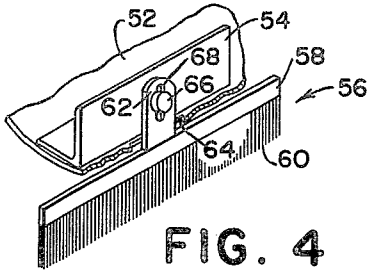
FIG. 4 is a perspective view of the section taken along the lines 4—4 of FIG. 2.
Figure 5:
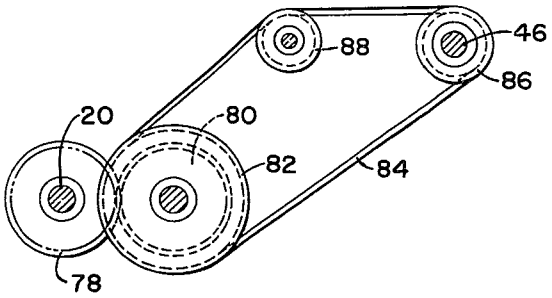
FIG. 5 is an elevational view of the drive train for the broom.
Figure 3:
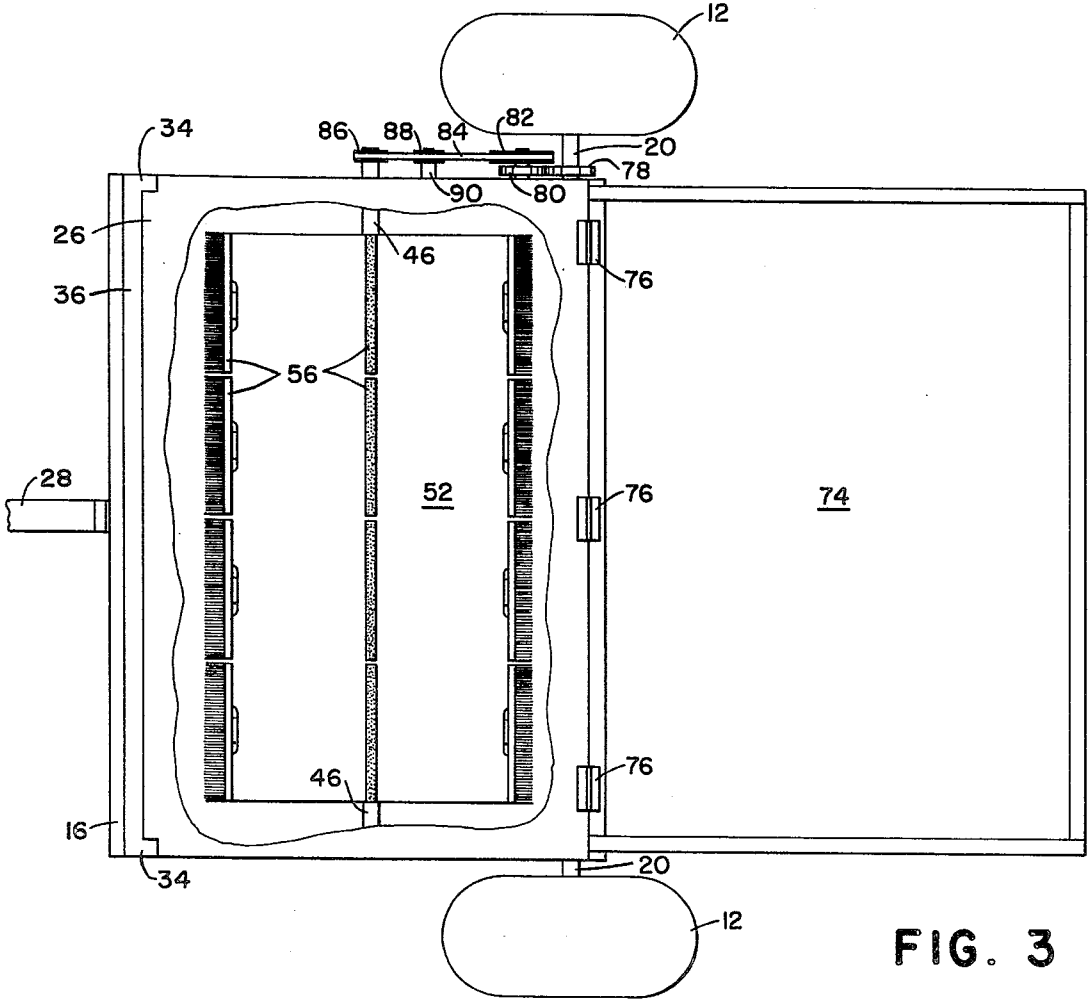
FIG. 3 is a top plan view with a section of the broom housing broken away to illustrate inner parts.

To guard the lower portion of the sweeping element which projects below the housing, the front wall of the housing extends below the lower front frame member 16 as can best be seen in FIG. 2, and a pair of skirt members 94 depend from the lower side frame members 14.

For operation, the lawn broom will be connected to a lawn and garden tractor or the like through the hitch 28. The operator will also lower the sweep element to the proper position through the adjusting strap 38. As the lawn broom is then moved forward the sweeping element will be caused to rotate in the direction indicated by the arrow 96 in FIG. 2. As the sweeping element is rotated, centrifugal force will move the brushes or sweep elements 56 outwardly to engage the lawn beneath the lawn broom. However, should any one or more of the sweep elements 56 engage a high portion of the ground it can be forced inwardly by the contact with the high portion of the lawn. As the brushes or sweep elements 56 engage debris, the debris is moved upwardly along the front of the sweeping element and thrown upwardly thereby. The sweep elements can also tilt from side to side to better conform to the ground contour. The debris moving upwardly within the housing will engage the integral front and top wall and be deflected rearwardly through the opening 70 in the rear wall 24 to the rear container. When the container is filled with debris it can easily be emptied by pivoting it about the axis of the hinges 76 so that the open front side thereof faces downwardly.

Having thus described a preferred embodiment of the invention, various modifications within the spirit and scope of the invention will become apparent to those skilled in the art and such modifications can be made without departing from the underlying principles of the invention. For example, because of the size of the lawn broom it will require considerable power to drive the sweeping element and it may therefore be desirable to mount an engine on the housing to drive the sweeping element rather than driving the sweeping element with the support wheels. Therefore, the invention should not be limited to the specific illustration and description, but only by the following claims.

I claim:

1. Mobile lawn sweeping apparatus comprising: a wheel supported housing adapted to be moved forwardly over a surface to be cleaned and having an open bottom; a rotary broom mounted in said housing for rotation about an axis transverse to the normal direction of movement of the housing and projecting through the open bottom of the housing; the rotary broom including a drum, a plurality of sweep elements disposed about and in radially outwardly projecting relation to the drum, and a plurality of means connecting the elements to the drum for rotation therewith and including combined radially slidable and pivotal connection means enabling the respective elements to move freely radially outwardly relative to the drum in response to centrifugal force as the drum rotates and to yield radially inwardly as well as to rock about an axis normal to the radial plane of the respective elements in response to variations in ground contour encountered by the elements.

2. Mobile apparatus as set forth in claim 1 wherein the rotary broom drum includes a pair of spaced, circular end walls mounted on and fixed to a driven shaft and an annular wall interconnecting the end walls, each of the sweep elements includes a sweep portion and a mounting portion in the form of a flat strap having one end rigidly secured to the sweep portion and its opposite end projecting through an opening provided in the annular wall, and the means mounting the sweep elements each includes an elongated slot provided in the flat strap, bracket means on the inner surface of the annular wall, and pin means carried by the bracket means and extending through the elongated slot.

3. Mobile apparatus as set forth in claim 1 wherein the rotary broom drum includes a pair of spaced, circular end walls mounted on and fixed to a driven shaft, an annular wall interconnecting the end members, and a plurality of elongated bracket members extending between the end walls and positioned in engagement with the inner surface of the annular wall, each of the sweep elements includes a sweep portion and a mounting portion in the form of a flat strap having one end rigidly secured to the sweep portion and its opposite end projecting through an opening provided in the annular wall adjacent one of the bracket members, and the mounting means for the sweep elements includes an elongated slot provided in the flat strap of each sweep element and a plurality of pin means carried by the bracket members and projecting through the elongated slots provided in the flat straps of the sweep elements.

4. Mobile apparatus for collecting lawn debris including a wheel supported housing adapted to be moved forwardly over the surface to be cleaned and having an open bottom, a rotary broom mounted in the housing for rotation about an axis transverse to the normal direction of movement of the housing and having at least a portion thereof projecting through the open bottom of the housing, and collector means connected to the housing for receiving debris from the rotary broom, characterized in that the rotary broom includes a drum, a plurality of sweep elements disposed about and in radially outwardly projecting relation to the drum and each having a sweep portion and a mounting portion, and lost motion mounting means connecting each of the sweep elements to the drum for rotation therewith and for free radially outwardly and inwardly movement through a predetermined range in response to centrifugal force as the drum rotates and variations in ground contour encountered by the elements, respectively.

5. Mobile apparatus as set forth in claim 4 further characterized in that the sweep elements are mounted on the drum to form a plurality of rows with each row consisting of a plurality of sweep elements.

6. Mobile apparatus as set forth in claim 5 wherein each of said mounting means includes an elongated slot provided in the mounting portion of the sweep element and a pin carried by the drum extending through the slot, whereby each sweep element is free to tilt with respect to the drum as well as move radially.

7. Mobile apparatus as set forth in claim 4 wherein the mounting portion of each sweep element consists of a single elongated flat strap having one end rigidly secured to the sweep portion of the sweep element, and each of the lost motion mounting means includes an elongated slot provided in the strap and a pin carried by the drum and projecting through the slot provided in the strap.

* * * * *